US006932631B2

(12) United States Patent
Huang

(10) Patent No.: US 6,932,631 B2
(45) Date of Patent: Aug. 23, 2005

(54) SOCKET PROTECTIVE COVER CAPABLE OF PREVENTING SINGLE-OPENING INSERTION

(75) Inventor: Chyong-Yen Huang, Taipei (TW)

(73) Assignee: Atom Technology Inc., Taipei (TW)

( * ) Notice: Subject to any disclaimer, the term of this patent is extended or adjusted under 35 U.S.C. 154(b) by 0 days.

(21) Appl. No.: 10/627,676

(22) Filed: Jul. 28, 2003

(65) Prior Publication Data

US 2005/0026482 A1 Feb. 3, 2005

(51) Int. Cl.[7] ..... H01R 13/44
(52) U.S. Cl. ..... 439/145; 439/143
(58) Field of Search ..... 439/145, 143, 439/137, 139, 140

(56) References Cited

U.S. PATENT DOCUMENTS 4,722,693 A * 2/1988 Rose ..... 439/137
4,867,694 A * 9/1989 Short ..... 439/137
6,537,088 B2 * 3/2003 Huang ..... 439/137

* cited by examiner

*Primary Examiner*—Chandrika Prasad

(57) ABSTRACT

A socket protective cover capable of preventing single-opening insertions includes a housing, a sliding base and covers. The housing has insertion openings. The sliding base is capable of transverse displacement in the housing, and has restoring elasticity. The covers are also provided with restoring elasticity, and have blocking members for extending into the insertion openings of the housing. When the blocking members at the covers are not simultaneously pushed and departed from the insertion openings, the other blocking member not pushed away from the insertion opening remains in the insertion opening and blocks sideward movements of the sliding base, thereby forbidding an alien object from pushing away the blocking members and thus preventing the alien object from entering the socket.

1 Claim, 9 Drawing Sheets

SOCKET PROTECTIVE COVER CAPABLE OF PREVENTING SINGLE-OPENING INSERTION

BACKGROUND OF THE INVENTION (a) Field of the Invention

The invention relates to a socket protective cover capable of preventing single-opening insertion, and more particularly, to a socket protective cover having covers capable of pivotally rotating in a sliding base for blocking members to block in insertion openings of a housing, thereby preventing entries of alien objects and accidental electric shocks.

(b) Description of the Prior Art

A common wall socket or an extension wire socket is generally provided with at least one set of receptacle, wherein each set of receptacle has two or three insertion openings. However, several drawbacks are found after studying the aforesaid prior socket. First of all, the "open" socket lacks protective measures, and accidental electric shocks are repeated occurrences among children caused by curiosity. Secondly, the prior socket is an open structure as described, with conductive straps at an interior thereof mostly being conductive materials such as copper. These conductive materials are often formed with aerugo resulted from humidity for being exposed in air over long periods of time, or accumulated with dust, and hence conductive efficiencies thereof become affected. Therefore, the prior socket has potential hazards to a certain degree, and can hardly be accounted as an ideal design when put to use.

SUMMARY OF THE INVENTION

The primary object of the invention is to provide a socket protective cover for blocking invasions of dust and preventing single-opening insertions of objects, thereby effectively avoiding accumulation of dust on conductive straps as well as accidental electric shocks.

To accomplish the aforesaid object, the invention comprises a housing, a sliding base and covers. The housing is provided with insertion openings. The sliding base is located in the housing to transversely displace therein, and has restoring elasticity. The covers are similarly provided with restoring elasticity, and have blocking members that can extend into the insertion openings of the housing. When pins of a plug simultaneously push against the blocking members at the covers, the covers are pivotally rotated on the sliding base and become tilted. Forces of the pins of the plug continuously imposed upon the covers then push the covers and also displace the sliding base sideward, such that the pins of the plug push open the covers and become inserted into the socket. However, when the blocking members at the covers are not simultaneously pushed and departed from the insertion openings, a blocking member not pushed away from the insertion opening is yet blocked in the insertion opening and prevents the sliding base to move sideward, thereby prohibiting an alien object from pushing open the covers.

DETAILED DESCRIPTION OF THE PREFERRED EMBODIMENTS

To better understand the invention, detailed descriptions shall be given with the accompanying drawings hereunder.

Figure 1:
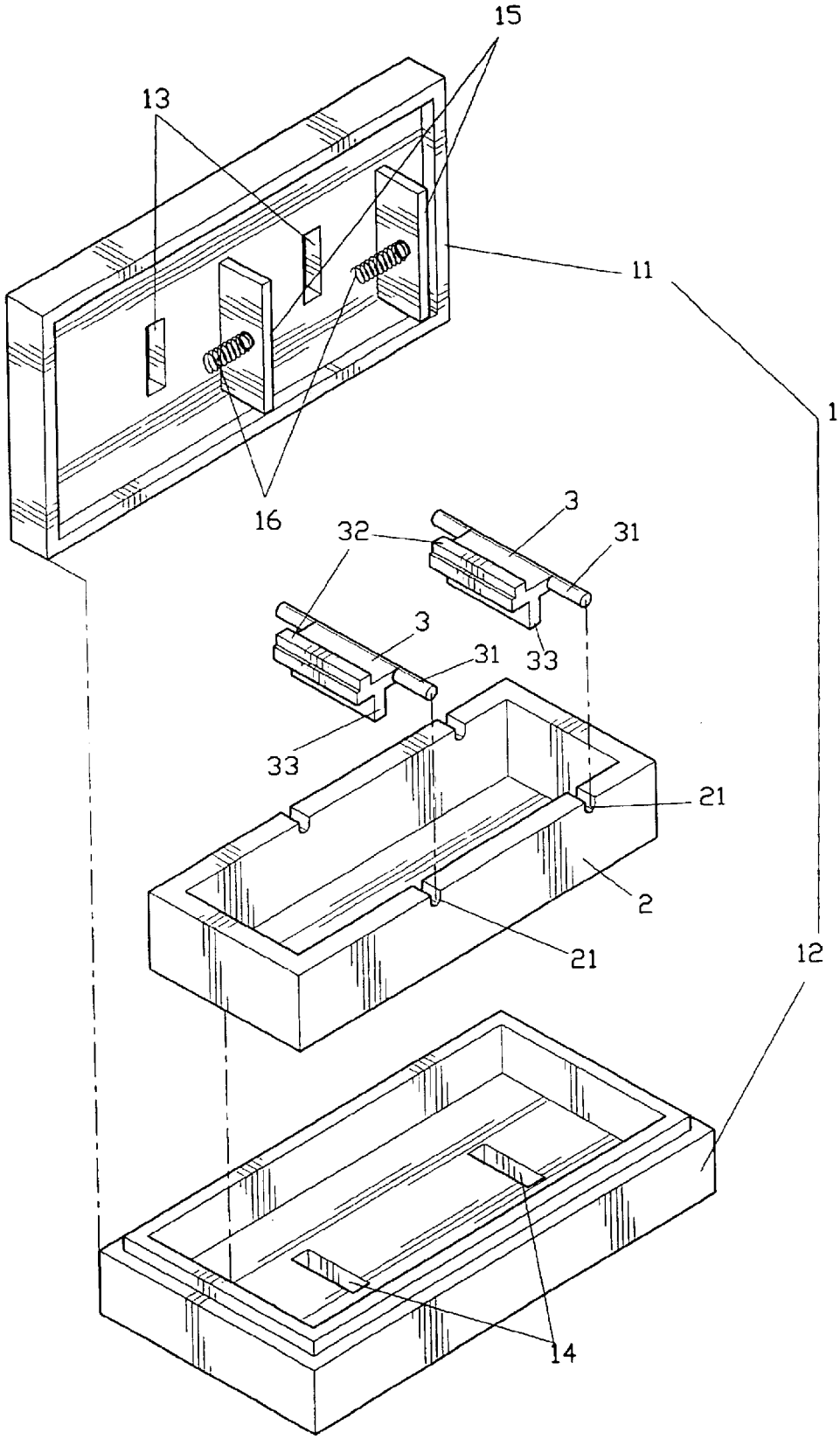
FIG. 1 shows an exploded elevational view according to the invention.

Referring to FIG. 1, the invention comprises a housing 1, a sliding base 2, and a covers 3.

The housing 1 is consisted of upper and lower housings 11 and 12. The upper and lower housings 11 and 12 are assembled by means of embedding, ultrasonic and screws; and are provided with two corresponding insertion openings 13 and 14 at outer sides thereof, respectively. The upper housing 11 further has two downwardly projecting fixing portions 15 at appropriate positions at an inner side thereof and next to the two insertion openings 13. Each of the two fixing portion 15 has a spring 16 transversely disposed.

The sliding base 2 is assembled in the housing 1; that is, between the upper and lower housings 11 and 12. The sliding base 2 is a hollow structure, and has two notches 21 at each of two side walls thereof.

The two covers 3 are disposed across and on the notches 21 at the side walls of the sliding base 2, respectively. Each cover 3 has a spindle 31 protruding at two sides thereof, respectively, a blocking member 31 at a top portion thereof, and a pressing member 33 at a bottom portion thereof.

Figure 2:
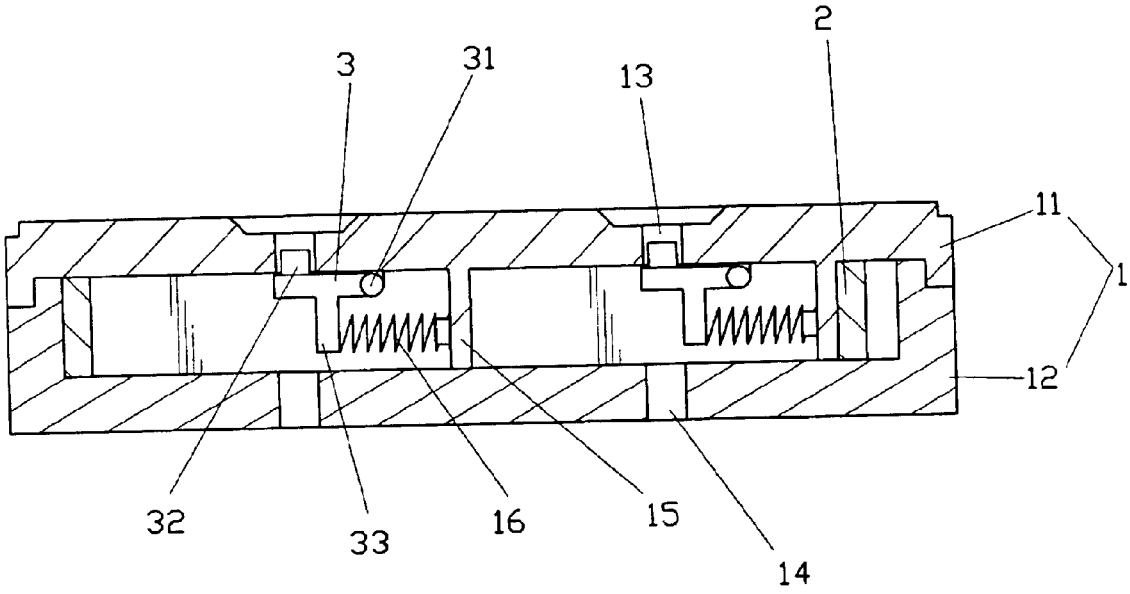
FIG. 2 shows a sectional view according to the invention.

Referring to FIG. 2, to assemble the invention, the spindles 31 of the two covers 2 are placed in the notches 21 at the two sides of the sliding base 2, and the sliding base 2 is assembled in the housing 1 (between the upper and lower housings 11 and 12 in this embodiment). Thus, the pressing members 33 at the bottom portions of the two covers 3 are butted against the springs 16 at the upper housing 11, the blocking members 31 at the top portions of the upper housing 11 are blocked in the insertion openings 13 of the upper housing 11, and the upper and lower housings 11 and 12 are sealed, joined and fastened.

Figure 3:
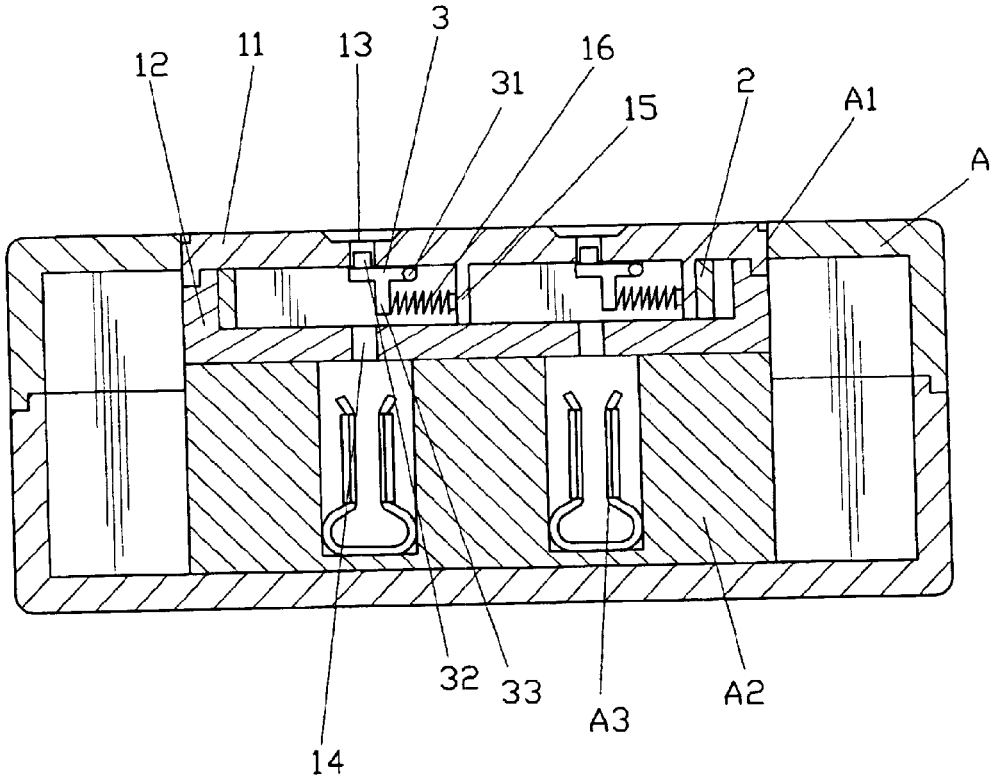
FIG. 3 shows a schematic view of an embodiment according to the invention.
Figure 4:
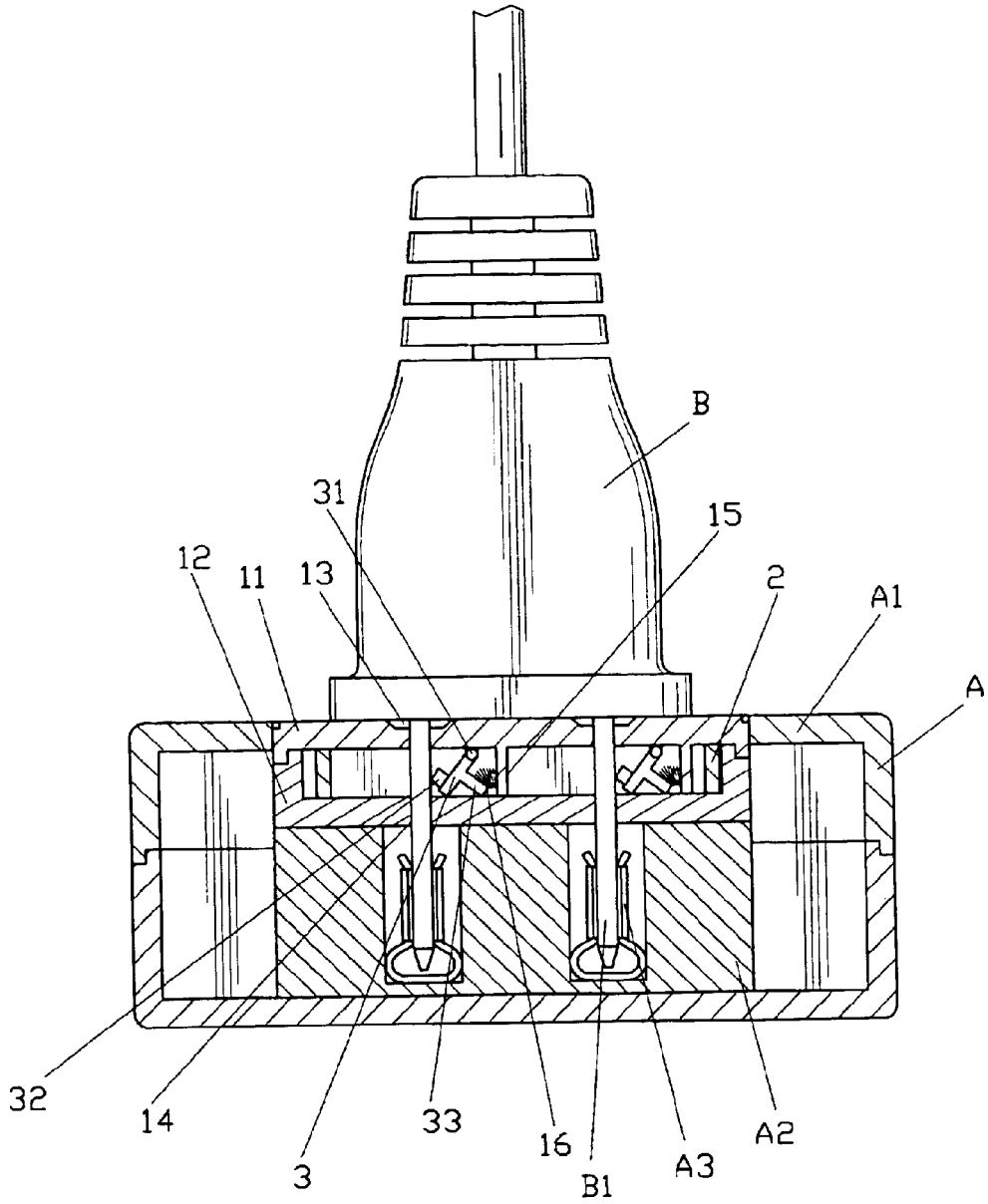
FIG. 4 shows a schematic view according to the invention being inserted by a plug.

Referring to FIGS. 3 and 4, to use the invention, the housing 1 is fastened in a fixing recess A1 of a socket A, and the insertion openings 14 of the lower housing 12 are aligned with conductive straps A3 in a casing A2 of the socket A. When two pins B1 of a plug B are inserted into the two insertion openings 14 of the lower housing 12, the two pins B1 of the plug B are simultaneously pushed against and instantaneously move the two blocking members 32 at the covers 3 downward At this point, the two covers 3 are rotated in the sliding base 2 due to circular spindles 31 thereof. When the blocking members 33 at the two covers 3 are departed from the insertion openings 13 in a downward direction, the pins B1 are allowed to continuously move downward. Presently, the pins B1 force the covers 3 to tilt and push against the lower housing 12. The pins B1 keep on imposing forces and generate a sideward thrust upon the tilted covers 3, such that the two covers 3 are displaced transversely, and meanwhile the pressing portions 33 at the bottom portions of the covers 3 are pressed against the two springs 16. The two spindles 31 at the two sides of the covers 3 are placed into the notches 21 at the two sides of the sliding base 2, and therefore the two covers 3 are able to simultaneously drive the sliding base 2 to move sideward when being transversely displaced. Hence, the two pins B1 are proceeded downward, penetrated through the insertion openings 14 of the lower housing 12, and inserted into the conductive straps A3 at the casing A2 of the socket A for conduction and acquiring power. When the pins B1 of the plug B are withdrawn, using restoring elasticity of the springs 16, the two covers 3 are able to push the pressing members 33 of the two covers 3, and restoring the sliding base 2 back to an original position thereof by driving and transversely moving the sliding base 2, as well as recovering the blocking members 32 at the two covers 3 back to original status thereof as blocking in the insertion openings 13 of the upper housing 11.

Figure 5:
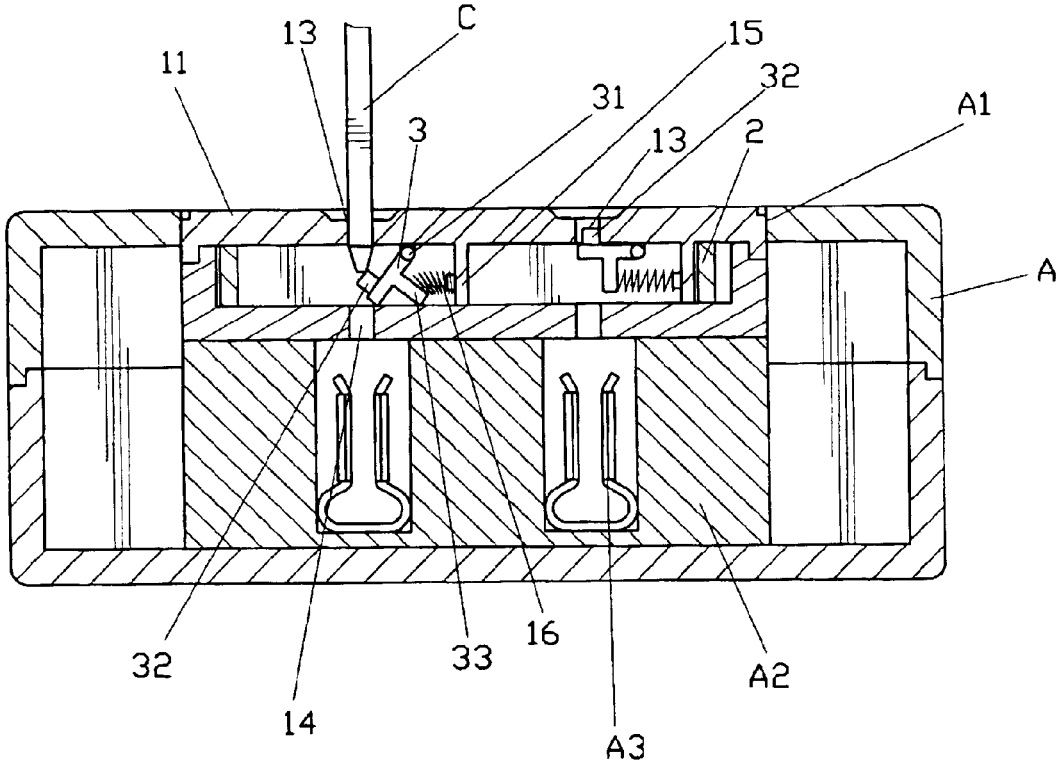
FIG. 5 shows a schematic view according to the invention being inserted by an alien object.

Referring to FIG. 5, when an alien object C is inserted into one of the insertion openings 13 of the upper housing 11, only the blocking member 32 at the specific cover 3 is pushed and moved downward, whereas the blocking member 32 at the other cover 3 remains still and continues blocking in the other insertion opening 13. The blocking member 32 moved downward drives and rotates the cover 3 in the sliding base 2 regarding the spindles 31 as a center thereof. However, when the cover 3 is rotated, the other blocking member 32 is yet blocked in the insertion opening 13 for that the other cover 3 is not rotated. Next, the sliding base 2 does not receive simultaneous transverse displacement and thrust of both the covers 3, and is thus incapable to move transversely, either. As a result, the blocking member 32 being pushed by the alien object C cannot be successfully moved sideward by still blocking below the alien object C, and the alien object C is incapable of keeping on pushing downward. Consequently, the alien object C fails to penetrate through the insertion openings 14 of the lower housing 12 to insert into the conductive straps A3 at the casing A2, thereby effectively preventing accidental electric shocks.

Figure 6:
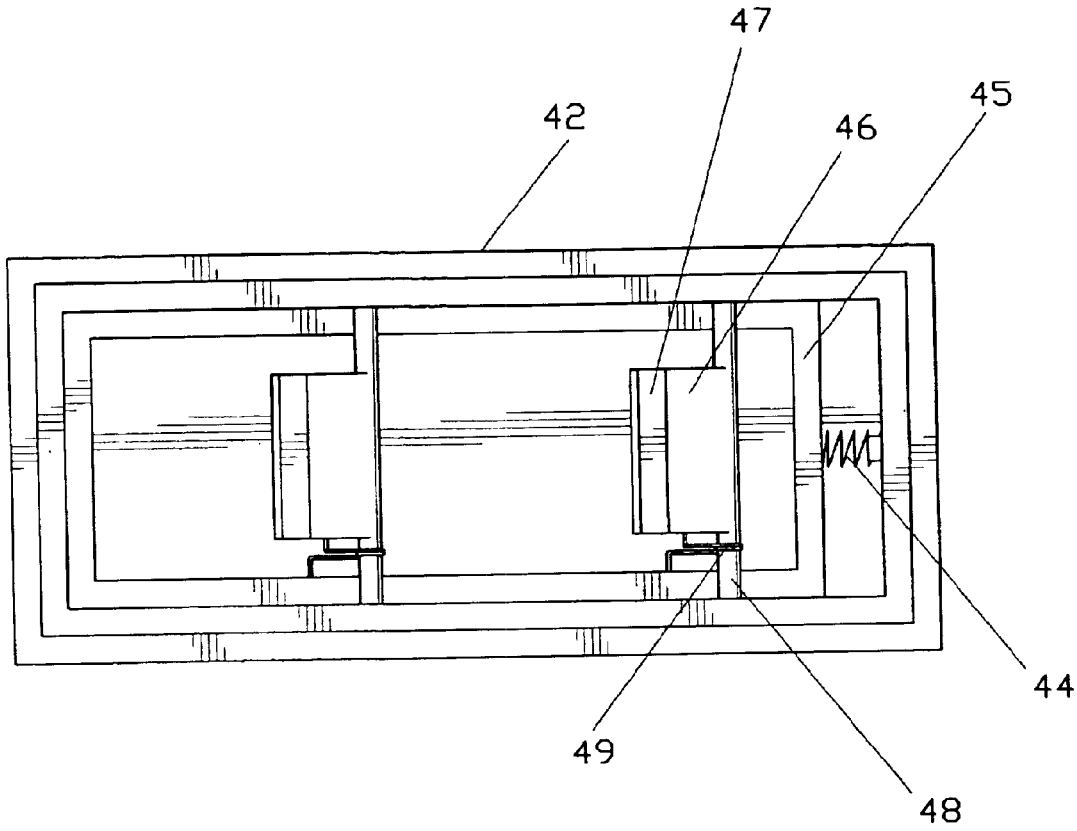
FIG. 6 shows a schematic view of the sliding base and the lower housing being assembled in a second embodiment according to the invention.
Figure 7:
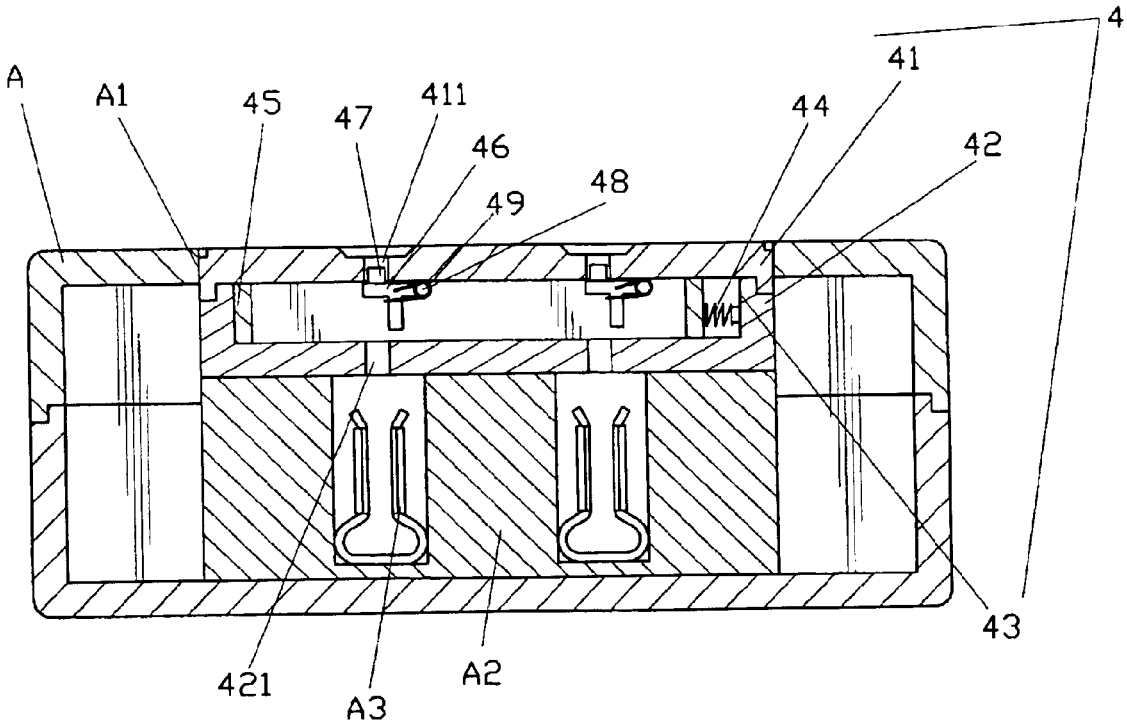
FIG. 7 shows a sectional view of a second embodiment according to the invention.

Referring to FIGS. 6 and 7 showing a second embodiment according to the invention, upper and lower housings 41 and 42 of a housing 4 have insertion openings 411 and 421, respectively. The upper housing 41 further has a fixing portion 43 and a spring 44 at a top portion of an inner side thereof. An interior (between the upper and lower housing 41 and 42 in this embodiment) of the housing 4 is disposed with a sliding base 45. The sliding base 45 has one outer edge thereof butted against one end of the spring 44, and is provided with two covers 46 at an interior thereof. A blocking member 47 at each cover 46 is blocked in the insertion openings 422, respectively. Spindles 48 at two sides of the two covers 46 are accommodated by a torsion spring 49, respectively. Each torsion spring 49 has one end thereof fixed at a side wall of each cover 46, whereas the other end thereof fixed at an inner wall of the sliding base 45. Hence, the housing 4 is fastened in the fixing recess A1 at the socket A, and the insertion openings 421 of the lower housing 42 are aligned with the conductive straps A3 at the casing A2 of the socket A. When inserting a plug under normal circumstances, pins of the plug shove the two covers 3 for transverse displacement, and the torsion springs 49 at the spindles 48 of the covers 46 are curled up. Using the transverse displacement of the covers 46, the sliding base 45 is further pushed for pressing against the springs 44, so as to smoothly complete the insertion. When withdrawing the plug, through elastic restoring forces of the torsion springs 49 and the springs 44, the sliding base 45 is recovered to an original position thereof via the covers 46. When an alien object is invaded into one of the insertion openings 411, the blocking member 47 at the cover 46 is yet blocked in the other insertion opening 411, thereby similarly accomplishing prevention of invasions of alien objects by having the sliding base 45 remain unmoved.

Figure 8:
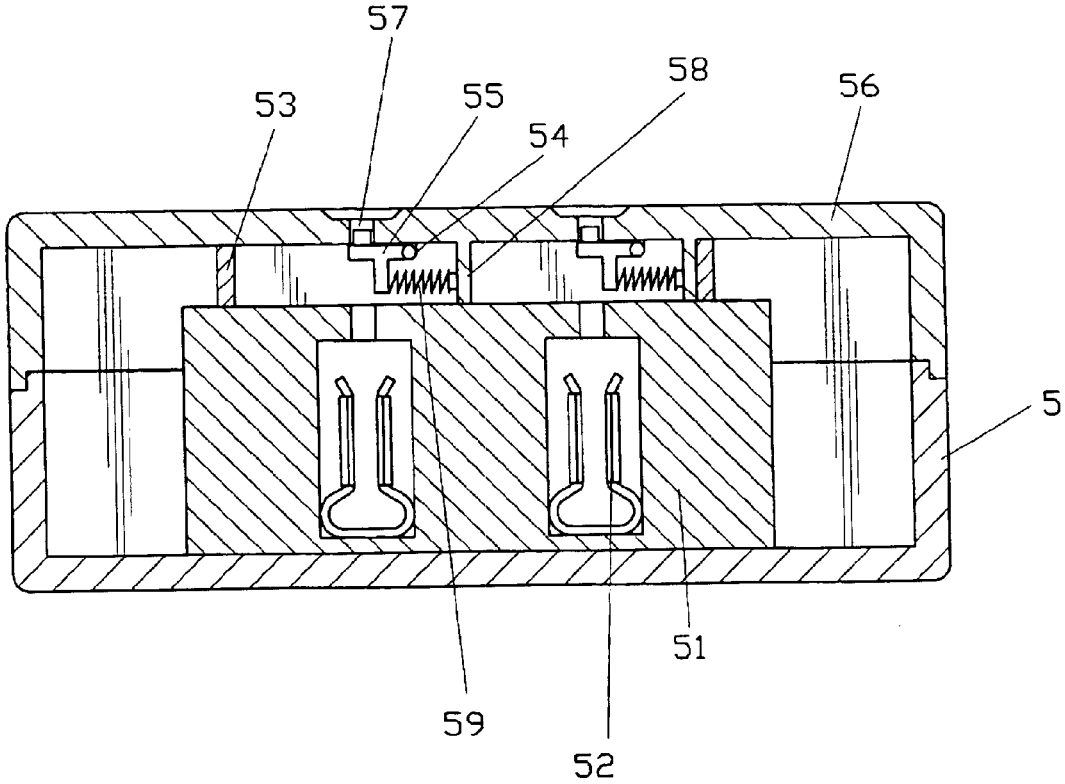
FIG. 8 shows a sectional view of a third embodiment according to the invention.

Referring to FIG. 8 showing a third embodiment according to the invention coordinating with a socket 5 having a different structure, a housing in this embodiment only consists of an upper housing 56 but not a lower housing. A casing 51 of the socket 5 has conductive straps 52 at an interior thereof. An upper portion of the casing 51 is for directly placing a sliding base 53, which has covers 55 placed across on notches 54 at two side walls thereof. The housing (the upper housing 56) is covered on the socket 5, and has two insertion openings 57 at an outer side thereof for corresponding with positions of the conductive straps 52. The upper housing 56 further has two downwardly projecting fixing portions 58 at appropriate positions at an inner side thereof and next to the two insertion openings 57. Each of the two fixing portion 58 has a spring 59 transversely disposed. Using the above structures, the upper housing 56 is directly covered onto the socket 5, and members including the sliding base 53 and the covers 55 are assembled in the housing (between the upper housing 56 and the casing 51), thereby accomplishing similar effects as other aforesaid embodiments.

Figure 9:
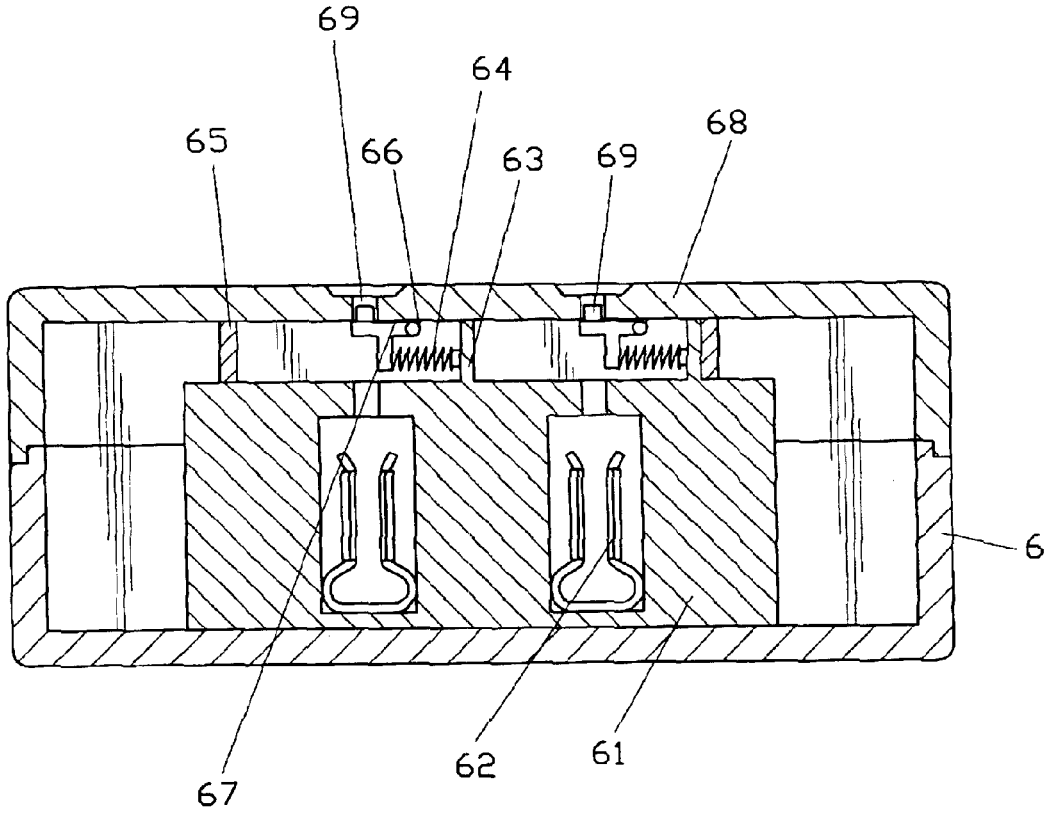
FIG. 9 shows a sectional view of a fourth embodiment according to the invention.

Referring to FIG. 9 showing a fourth embodiment according to the invention coordinating with a socket 6 having a different structure, a housing only consists of an upper housing 68 but not a lower housing in this embodiment. A casing 61 of the socket 6 has conductive straps 62 at an interior thereof, and two projecting fixing portions 63 at a top portion thereof. Each of the two fixing portion 63 has a spring 64 transversely disposed. Outer peripheries of the two fixing portion 63 are for placing a sliding base 65. Covers 67 are placed across on notches 66 at two side walls of the sliding base 65. The housing (the upper housing 68) is covered onto the socket 6, and has insertion openings 69 provided at an outer side thereof for corresponding with positions of the conductive straps 62. Using the aforesaid structure, members including the sliding base 65 and the covers 67 are assembled in the housing (between the upper housing 68 and the casing 61 in this embodiment); thereby accomplishing similar effects as other aforesaid embodiments.

Conclusive from the above descriptions, the invention has the following excellences:

1. When one of the insertion openings is inserted by an alien object, the cover in the insertion opening being inserted is incapable of pushing and moving the sliding base, while the blocking member at the other cover remains blocked in the corresponding insertion opening. Hence, the invention provides excellent safety precautions by prohibiting single-opening insertions of alien objects and thus accidental electric shocks.
2. When withdrawing a plug, the covers automatically cover the insertion openings, and therefore provide dust-proof effects.
3. The invention may be implemented by coordinating with sockets of various styles for offering manufacturing and assembly with diversification. The structure according to the invention has a wide range of applicability and can be applied in extension sockets and wall sockets.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A protective socket for preventing single-opening insertion comprising:

a housing having a plurality of insertion openings;

a sliding base assembled in the housing; the sliding base being capable of transverse sliding movements in the housing;

a plurality of covers disposed at corresponding positions of the insertion openings; the covers being capable of pivotal rotations and capable of restoring forces on the sliding base established by restoring elastic means disposed in the sliding base; the covers further including a plurality of blocking members for extending into the insertion openings of the housing;

when the blocking members at the covers are simultaneously pushed and departed from the insertion openings, the covers are pivotally rotated and tilted on the sliding base, and a subsequent force imposed upon the covers pushes the covers and the sliding base sideward; when the blocking members at the covers are not simultaneously pushed and departed from the insertion openings, one of the blocking members not pushed away from the insertion opening remains in the insertion opening and blocks displacement of the sliding base.

* * * * *